US010544597B2

(12) United States Patent
Resnick et al.

(10) Patent No.: US 10,544,597 B2
(45) Date of Patent: Jan. 28, 2020

(54) TOOL ATTACHMENT FOR RAKING MORTAR JOINTS

(71) Applicant: Rhino Tools and Equipment Inc., Pittsburgh, PA (US)

(72) Inventors: Samuel Resnick, Rockville Center, NY (US); Elizabeth Bianchini, Pittsburgh, PA (US); Kyler Kocher, Mesa, AZ (US); Ann McInroy, Laramie, WY (US)

(73) Assignee: Rhino Tools and Equipment Inc., Pittsburgh, PA (US)

( * ) Notice: Subject to any disclaimer, the term of this patent is extended or adjusted under 35 U.S.C. 154(b) by 14 days.

(21) Appl. No.: 16/108,954

(22) Filed: Aug. 22, 2018

(65) Prior Publication Data

US 2019/0169862 A1 Jun. 6, 2019

Related U.S. Application Data

(60) Provisional application No. 62/708,336, filed on Dec. 4, 2017.

(51) Int. Cl.
*B24B 55/10* (2006.01)
*E04F 21/165* (2006.01)
(Continued)

(52) U.S. Cl.
CPC ..... *E04F 21/1652* (2013.01); *B24B 55/10* (2013.01); *E01C 19/12* (2013.01); *E04F 21/165* (2013.01); *E04F 21/241* (2013.01)

(58) Field of Classification Search
CPC ... E04F 21/1652; E04F 21/241; E04F 21/165; E01C 19/12; B24B 27/0092; B24B 55/04; B24B 55/05; B24B 55/06; B24B 55/10
(Continued)

(56) References Cited

U.S. PATENT DOCUMENTS 2,526,662 A * 10/1950 Hipps ..... A61B 17/1635 408/67
2,619,721 A * 12/1952 King ..... A01G 3/08 30/371
(Continued)

FOREIGN PATENT DOCUMENTS

DE 3312019 10/1984
WO WO 2004/080635 9/2004

OTHER PUBLICATIONS

'woodworkingtips.com' [online]. "Woodworking Tips: Reducing Tool Noise, Part 1," dated Mar. 4, 2000 [retrieved on Sep. 7, 2018]> Retrieved from the Internet: URL <http://woodworkingtips.com/etips/etip26.html>. 2 pages.
(Continued)

*Primary Examiner* — Eileen P Morgan
(74) *Attorney, Agent, or Firm* — Fish & Richardson P.C.

(57) ABSTRACT

An apparatus configured to be mounted to a power tool includes a hollow shaft configured to surround an operating element of the power tool; a substantially flat sled, in which a bottom surface of the sled is configured to interface with a working surface; and a guidance fin protruding from the bottom surface of the sled, wherein the guidance fin is configured to guide the apparatus along an operating path. The apparatus may include at least one vacuum port attachment, which can be mounted to a top surface of the sled and/or may be built into a support member of the apparatus. The apparatus may include a clamp configured to mount the apparatus to the power tool. The power tool can be a rotary hammer drill.

28 Claims, 6 Drawing Sheets

(51) Int. Cl.
*E04F 21/24* (2006.01)
*E01C 19/12* (2006.01)

(58) Field of Classification Search
USPC ..... 451/340, 344, 415, 451, 456
See application file for complete search history.

(56) References Cited

U.S. PATENT DOCUMENTS

| | | | | | |
|---|---|---|---|---|---|
| 2,623,557 | A * | 12/1952 | Kendall | B23D 59/006 | 144/134.1 |
| 3,938,251 | A | 2/1976 | Kareman | | |
| 4,090,297 | A * | 5/1978 | Wanner | B23D 49/162 | 30/124 |
| 4,155,142 | A | 5/1979 | Demetriadis | | |
| 4,213,242 | A * | 7/1980 | Partington | B23D 49/162 | 30/374 |
| 4,391,013 | A | 7/1983 | Janssen | | |
| 4,435,923 | A * | 3/1984 | Regina | B24B 23/04 | 15/235.3 |
| 4,440,045 | A * | 4/1984 | Aksamit | B23D 63/162 | 451/451 |
| 4,558,481 | A | 12/1985 | Jones | | |
| 4,586,890 | A | 5/1986 | Marchbanks | | |
| 4,682,383 | A | 7/1987 | Brenish et al. | | |
| 4,784,598 | A | 11/1988 | Kranz et al. | | |
| 4,856,135 | A | 8/1989 | Stewart | | |
| 4,907,955 | A | 3/1990 | Snipes | | |
| 5,058,275 | A | 10/1991 | Staubli | | |
| 5,239,725 | A | 8/1993 | White | | |
| 5,471,704 | A | 12/1995 | Woolley | | |
| 5,644,847 | A * | 7/1997 | Odendahl | B23D 51/025 | 30/371 |
| 6,412,181 | B1 * | 7/2002 | Pracas | B23D 49/11 | 30/392 |
| 6,578,229 | B1 | 6/2003 | Dziallas et al. | | |
| 6,735,876 | B2 | 5/2004 | Hirabayashi | | |
| 7,127,769 | B2 | 10/2006 | Chang et al. | | |
| 7,131,180 | B2 * | 11/2006 | Kopras | B25F 3/00 | 29/560 |
| 7,338,270 | B2 | 3/2008 | Mathews | | |
| 7,386,914 | B2 | 6/2008 | Cruzan | | |
| 7,484,263 | B2 | 2/2009 | Rice | | |
| 7,908,702 | B2 | 3/2011 | Accumanno | | |
| 8,033,026 | B2 * | 10/2011 | Gibbons | B23D 51/025 | 30/371 |
| 8,578,615 | B2 * | 11/2013 | Baskar | B23D 51/03 | 30/376 |
| 8,974,219 | B2 | 3/2015 | Couch | | |
| 10,029,322 | B2 * | 7/2018 | Van Wambeke | B23D 49/162 | |
| 10,071,504 | B2 * | 9/2018 | Weinhardt | B28D 1/185 | |
| 2005/0000052 | A1 * | 1/2005 | Byles | A47L 9/02 | 15/314 |
| 2005/0249561 | A1 * | 11/2005 | Clark | B23Q 11/0046 | 408/204 |
| 2012/0260458 | A1 * | 10/2012 | King, Jr. | A47L 7/0095 | 15/415.1 |
| 2014/0302758 | A1 * | 10/2014 | Moncrieff | B26B 29/00 | 451/451 |
| 2018/0125313 | A1 * | 5/2018 | King, Jr. | A47L 7/0095 | |

OTHER PUBLICATIONS

'www.arbortechtools.com' [online]. "Allsaw AS170: Allsaw Technology," dated 2017 [retrieved on Feb. 7, 2018]. Retrieved from the Internet: URL <https://www.arbortechtools.com/us/as170/>. 7 pages.
'www.brandontoolhire.co.uk' [online]. "Vibration Safety Guide," dated Apr. 29, 2015 [retrieved on Sep. 7, 2018]. Retrieved from the Internet: URL <http://www.brandontoolhire.co.uk/themes/brandon/downloads/Vibration_Safey_Guide.pdf>. 4 pages.
'www.coptool.com' [online]. "Drill vs Impact Driver vs Hammer Drill vs Rotary Hammer Drill," dated Aug. 30, 2010 [retrieved on Sep. 7, 2018]. Retrieved from the Internet: URL <http://www.coptool.com/drill-vs-impact-driver-vs-rotary-hammer-drill/>. 8 pages.
'www.familyhandyman.com' [online]. "What is a Hammer Drill vs. Rotary Hammers," dated Nov. 17, 2014 [retrieved on Sep. 7, 2018]. Retrieved from the Internet: URL <https://www.familyhandyman.com/tools/drills/drilling-into-concrete-tools-rotary-hammers-and-hammer-drills/view-all/>. 8 pages.
'www.homedepot.com' [online]. "Makita 10 Amp SJS II Angle Grinder with 5 in. Tuck Point Guard," dated Jul. 22, 2015 [retrieved on Sep. 7, 2018]. Retrieved from the Internet: URL <https://www.homedepot.com/p/Makita-10-Amp-SJS-II-Angle-Grinder-with-5-in-Tuck-Point-Guard-GA5040X1/206058493>.
'www.sunrisetools.com' [online]. "180 mm C-Tec Cutting & Chasing System," [undated] [retrieved on Sep. 7, 2018]. Retrieved from the Internet: URL <https://www.sunrisetools.co.uk/dust-control/cutting-chasing/c-tec/180-mm-e-tec-cutting-system.html>. 3 pages.
'www.sunrisetools.com' [online]. "C-Tec," dated May 29, 2016 [retrieved on Sep. 7, 2018]. Retrieved from the Internet: URL <https://www.sunrisetools.co.uk/dust-control/cutting-chasing/c-tec/>. 6 pages.
'www.toolsofthetrade.net' [online]. "Bosch Mortar Knife," dated Apr. 5, 2014 [retrieved on Sep. 7, 2018]. Retrieved from the Internet: URL < https://www.toolsofthetrade.net/power-tools/blades-bits-cords/bosch-mortar-knife_o>. 3 pages.
'www.who.int' [online]. "Noise Sources," dated Jun. 26, 2006 [retrieved on Sep. 7, 2018]. Retrieved from the Internet: URL <http://www.who.int/occupational_health/publications/noise5.pdf>. 22 pages.
'www.worksafe.govt.nz' [online]. "Noise Levels Created by Common Construction Tools," dated Mar. 2015 [retrieved on Sep. 7, 2018]. Retrieved from the Internet: URL <https://worksafe.govt.nz/dmsdocument/2293-noise-levels-created-by-common-construction-tools>. 4 pages.
'www.youtube.com' [online]. "Hammer drill vs. rotary hammer," dated Sep. 11, 2011 [retrieved on Sep. 7, 2018]. Retrieved from the Internet: URL <https://wwww.youtube.com/watch?y=6UMY4lkcCgE>. 3 pages.
'www.youtube.com' [online]. "How to Use a Rotary Hammer Drill," dated Oct. 31, 2016 [retrieved on Sep. 7, 2018]. Retrieved from the Internet: URL <https://www.youtube.com/watch?v=Zpn6UDTpuXM>. 2 pages.
'www.youtube.com' [online]. "Morta Sortas. Make raking out mortar easy," dated Apr. 16, 2009 [retrieved on Sep. 7, 2018]. Retrieved from the Internet: URL <https://www.youtube.com/watch?v=POZLIPOqirs>. 3 pages.
'wwww.popularmechanics.com' [online]. "Hammer Drill vs. Rotary Hammer: Tool Test," dated Apr. 14, 2010 [retrieved on Sep. 7, 2018]. Retrieved from the Internet: URL <https://www.popularmechanics.com/home/tools/reviews/a5611/drill-rotary-hammer-concrete-comparison/>. 9 pages.
IBIS World Industry Report 33312: Construction Machinery and Manufacturing in the US, IBISWorld, 2017, 39 pages.
'www.instagram.com' [online]. "Today we took a field trip to the Bricklayers Apprenticeship Training center to show off Rhino . . . I think they liked it," Dec. 5, 2017 [retrieved on Oct. 9, 2018]. Retrieved from the Internet: URL https://www.instagram.com/p/BcUJB8JB9ZD/?taken-by=009orange 1 page.
'www.instagram.com' [online]. "What rhymes with door hinge? Orange!," Nov. 18, 2017 [retrieved on Oct. 9, 2018]. Retrieved from the Internet: URL https://www.instagram.com/p/BcUJB8JB9ZDf1taken-by=009orange 1 page.
International Search Report and Written Opinion in Application No. PCT/US2018/47490, dated Nov. 1, 2018, 13 pages.

* cited by examiner

TOOL ATTACHMENT FOR RAKING MORTAR JOINTS

CROSS-REFERENCE TO RELATED APPLICATIONS

This application claims the benefit of priority under 35 U.S.C. Section 119(e) to U.S. Provisional Patent Application No. 62/708,336, filed on Dec. 4, 2017, the entire contents of which are incorporated herewith by reference.

BACKGROUND

This description relates to a tool attachment for raking mortar joints. Raking mortar joints is a typical step in repointing structures and can be useful for increasing the lifetime and structural integrity of brick buildings, stone walls, and other masonry constructed structures.

In masonry, structures are generally built from individual units held together by hardened mortar. For example, a brick building is a masonry constructed structure in which the bricks (the individual units) are held together by a mixture of water, sand, and cement (the mortar). The space between the individual units that is filled or intended to be filled with mortar is called a mortar joint. With the passage of time, mortar can deteriorate, weaken, become damaged, etc.

SUMMARY

The apparatus, systems, and techniques described herein can aid individuals such as masons, construction workers, homeowners etc. with joint raking. An attachment for a power tool, such as a powered rotary hammer drill, may increase control of the power tool by stabilizing and guiding the tool during a joint raking operation. By providing users better control of the power tool, the attachment enables users to remove mortar with reduced fatigue, fine dust particles, and damage to individual units of a masonry constructed structure compared to conventional apparatuses, systems, and techniques for repointing.

In one aspect, an apparatus configured to be mounted to a power tool includes a hollow shaft configured to surround an operating element of the power tool; a substantially flat sled, in which a bottom surface of the sled is configured to interface with a working surface; and a guidance fin protruding from the bottom surface of the sled, wherein the guidance fin is configured to guide the apparatus along an operating path.

Implementations may include one or more of the following features. The guidance fin may protrude substantially perpendicularly from the bottom surface of the sled, may be configured to fit into a mortar joint, and/or may have a width that is less than a width of the operating element of the power tool. The power tool can be a rotary hammer drill. The hollow shaft can be oriented at an acute or an obtuse angle relative to the sled. At least one edge of the substantially flat sled may be configured to curve away from the working surface. The apparatus can be configured to rotate relative to the power tool about a longitudinal axis of the hollow shaft. A dimension of at least one of the hollow shaft, the sled, and the guidance fin can be adjustable. A front aspect of a distal end of the hollow shaft may have a cutout. A front aspect of the sled may be bifurcated. The apparatus may include at least one vacuum port attachment, which can be mounted to a top surface of the sled and/or may be built into a support member of the apparatus. The apparatus may include a clamp configured to mount the apparatus to the power tool.

The clamp, which can be a split collar clamp, may be configured to interface with a chuck of the power tool and may have a cam-operated tightening mechanism. The apparatus can be configured to rotate relative to the power tool about a longitudinal axis of the hollow shaft only when the clamp is in an unlocked configuration. The clamp can include at least one locator feature for locating at least one predetermined position of the apparatus, and the least one locator feature may be a ball detent.

In another aspect, a system includes a power tool with an operating element; a hollow shaft configured to surround the operating element; a substantially flat sled, wherein a bottom surface of the sled is configured to interface with a working surface; and a guidance fin protruding perpendicularly from the bottom surface of the sled, wherein the guidance fin is configured to guide the apparatus along an operating path.

Implementations may include one or more of the following features. The hollow shaft and/or the sled may be irremovable from the power tool. The guidance fin may protrude substantially perpendicularly from the bottom surface of the sled, may be configured to fit into a mortar joint, and/or may have a width that is less than a width of the operating element of the power tool. The power tool can be a rotary hammer drill. The hollow shaft can be oriented at an acute or an obtuse angle relative to the sled. At least one edge of the substantially flat sled may be configured to curve away from the working surface. The sled can be configured to rotate relative to the power tool about a longitudinal axis of the hollow shaft. A dimension of at least one of the hollow shaft, the sled, and the guidance fin can be adjustable. A front aspect of a distal end of the hollow shaft may have a cutout. A front aspect of the sled may be bifurcated. The system may include at least one vacuum port attachment, which can be mounted to a top surface of the sled and/or may be built into a support member of the system.

In another aspect, an apparatus that is configured to be rotatably mounted to a power tool includes a hollow shaft, a substantially flat sled, a guidance fin, at least one vacuum port attachment, and a split collar clamp. The hollow shaft is configured to surround an operating element of the power tool, and a front aspect of a distal end of the hollow shaft has a cutout. The sled is oriented at an acute angle relative to the hollow shaft. A front aspect of the sled is bifurcated and a bottom surface of the sled is configured to interface with a working surface. The guidance fin protrudes substantially perpendicularly from the bottom surface of the sled and has a width that is less than a width of the operating element of the power tool. The guidance fin is configured to fit inside a mortar joint and guide the apparatus along an operating path. The at least one vacuum port attachment is built into a support member of the apparatus. The split collar clamp is configured to interface with a chuck of the power tool. The clamp has a cam-operated tightening mechanism and at least one locator feature for locating at least one predetermined position of the apparatus. The apparatus is configured to rotate relative to the power tool about a longitudinal axis of the hollow shaft.

These and other aspects, features, and various combinations may be expressed as apparatuses, systems, methods, means for performing functions, etc.

Other features and advantages will be apparent from the description and the claims.

DETAILED DESCRIPTION

Figure 1:
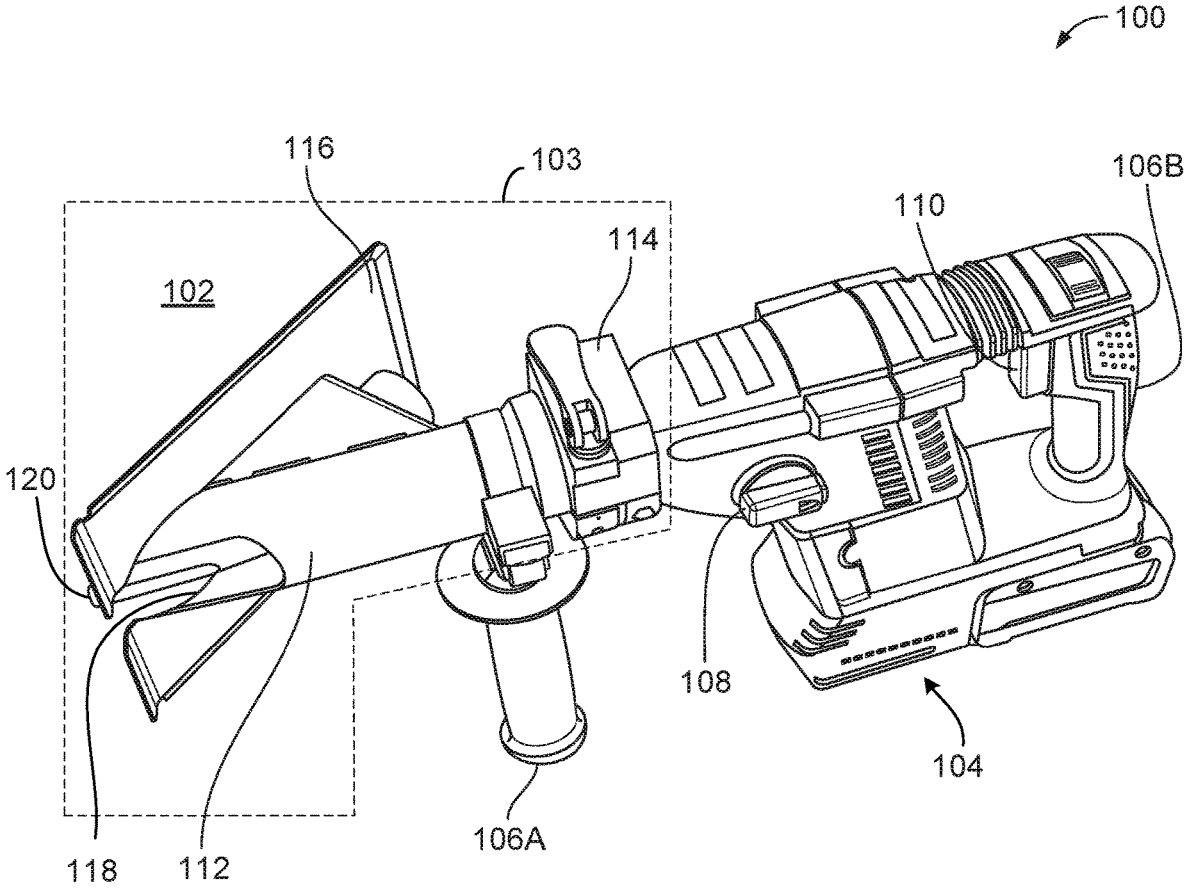
FIG. 1 is a side perspective view of a rotary hammer drill with a joint raking tool attachment.

In masonry, mortar is used for the spacing of individual units, adhering the individual units, and maintaining the structural integrity of the masonry constructed structure. Over time, the mortar in a masonry constructed structure can deteriorate at a rate dependent on factors including pollution, moisture, material selection, and workmanship quality. In some cases, to increase the lifetime and structural integrity of masonry constructed structures, damaged mortar is removed from mortar joints and replaced with fresh mortar through a process called repointing. The removal of the mortar from the mortar joints is commonly referred to as joint raking.

Conventional tools used for joint raking include hand tools powered solely by manual labor such as masonry mash hammers and chisels. The use of these hand tools may be tiring, may limit the rate at which joint raking can be completed, and may generate unsafe or undesired quantities of fine dust as the mortar is removed. The use of power tools such as power saws and grinders can reduce user fatigue and increase the rate of mortar removal compared to the use of hand tools powered solely by manual labor. However, conventional power tools used for joint raking may cause damage to the individual units due to lack of control, may provide cuts of non-uniform depth, and may generate large quantities of unsafe or undesired fine dust as the mortar is removed. Consequently, there is a need for tools and tool attachments that enable rapid and well-controlled joint raking with minimal damage to the individual units and reduced generation of fine dust particles.

Here, we describe, among other things, a tool attachment that can be used in combination with power tools (e.g. a rotary hammer drill) to assist users in performing tasks such as joint raking. Users may include, but are not limited to, masons, construction workers, homeowners, and any other persons responsible for maintaining a masonry constructed structure.

We use the term "power tool" broadly to include, for example, any combination of hardware or software components or both that is used to carry out a particular function and has a power source other than pure manual labor. Examples of power tools include, but are not limited to, rotary hammer drills, hammer drills, electric grinders, power saws, and power sanders.

We use the term "joint raking" broadly to include, for example, any removal of mortar or other material from a mortar joint. In some cases, mortar may be removed from the mortar joint because it has been damaged or deteriorated due to factors such as pollution, moisture, material selection, and workmanship quality.

We use the term "mortar joint" broadly to include, for example, any space between individual units in a constructed structure such as a masonry constructed structure. In some cases, the individual units may comprise bricks, stones, concrete blocks, cast stone, glass block, adobe, or any combination of them. In some cases, the mortar may comprise a mixture of water, sand, polymers, lime, pozzolana, or any combination of them, among other things.

FIG. 1 illustrates a joint raking system 100 configured to assist a user in removing mortar from a mortar joint. The joint raking system 100 includes a joint raking tool attachment 102 mounted to a rotary hammer drill 104. The joint raking tool attachment 102 is highlighted by a dashed box 103. The rotary hammer drill 104 can include two handles 106A-B for a user to hold, a switch 108 for changing an operating mode of the rotary hammer drill 104, a trigger 110 for enabling operation of the rotary hammer drill 104, and an operating bit 120 that, during operation, interfaces with a working surface. In some cases, the operating bit 120 may be a drill bit, a chisel bit, etc. ranging from about 1/32" to about 3" in diameter or width. In some cases, the operating bit 120 may be made of steel (e.g. carbon steel, high speed steel, etc.) and may optionally be coated with cobalt, titanium, or zirconium, among other materials.

The joint raking tool attachment 102 comprises a hollow shaft 112 that substantially surrounds the operating bit 120 of the rotary hammer drill 104 and is mounted, at a proximal end, to the rotary hammer drill 104 via a split collar clamp 114 (e.g., mounted to a chuck of the rotary hammer). At a front aspect of a distal end of the hollow shaft 112 a cutout 118 partially exposes a tip of the operating bit 120 of the rotary hammer drill 104. The joint raking tool attachment 102 further includes a sled 116 that, during a joint raking operation, interfaces with the working surface. The joint raking tool attachment 102 and the split collar clamp 114 are later described in relation to FIGS. 2-6.

While a rotary hammer drill is depicted in FIG. 1, in some cases, the joint raking tool attachment 102 can be attached to other kinds of power tools such as a handheld power drill or a hammer drill. In some implementations, a rotary hammer drill is used for joint raking because the motion and small cross-sectional area of the operating bit 120 enables finer control of mortar removal from tight mortar joints and produces debris with larger particle diameter (e.g. on the order of 0.25 cm to 5 cm) than conventionally used power tools such as electric grinders and circular power saws. In some cases, the quantity and average particle diameter of debris is larger than at least one regulated threshold (e.g. a threshold established by silica laws).

Figure 2A:
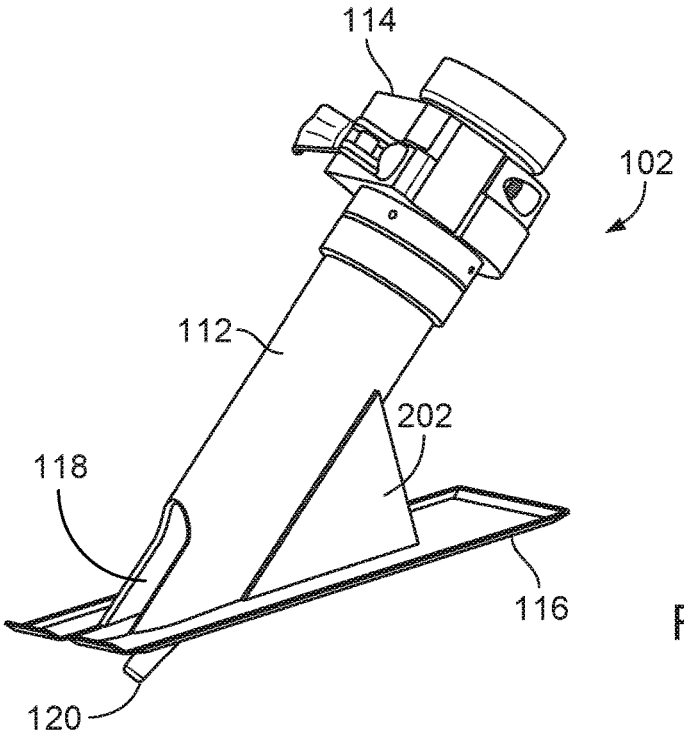
FIG. 2A is a side perspective view of a joint raking tool attachment.
Figure 2B:
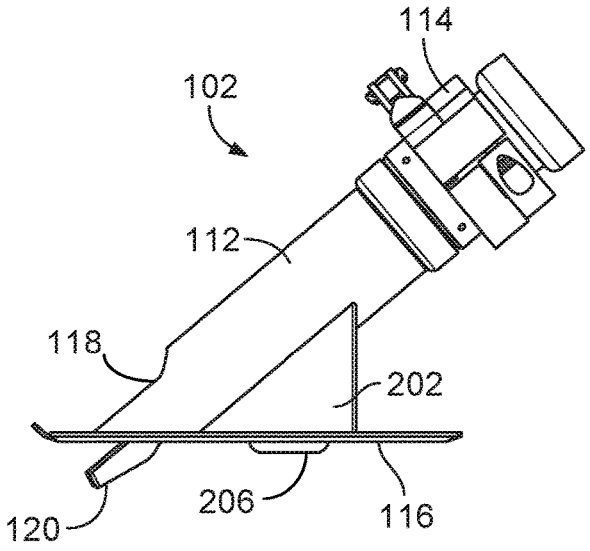
FIG. 2B is a side view of a joint raking tool attachment.
Figure 2C:
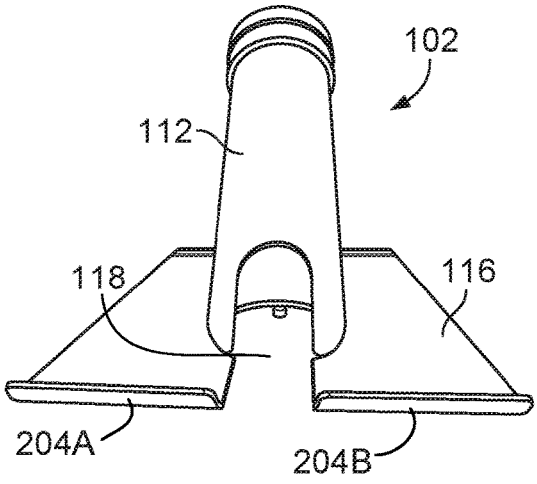
FIG. 2C is a front view of a joint raking tool attachment.

Referring to FIGS. 2A-C, the joint raking tool attachment 102 is isolated from the rotary hammer drill 104 and shown in greater detail. FIG. 2A illustrates a side perspective view, FIG. 2B illustrates a side view, and FIG. 2C illustrates a front view of the joint raking tool attachment 102. In FIG. 2A and FIG. 2B, the split collar clamp 114 is depicted mounted to the proximal end of the hollow shaft 112, providing a means for attaching the joint raking tool attachment 102 to the chuck of the rotary hammer drill 104.

When the joint raking tool attachment 102 is mounted to the rotary hammer drill 104, the hollow shaft 112 is configured to extend longitudinally along the axis of the operating bit 120 and substantially surround the operating bit 120. At the distal end of the hollow shaft, the cutout 118 is configured to expose a distal tip of the operating bit 120, enabling the operating bit 120 to interface with a working surface such as a brick wall. The hollow shaft 112 provides protection to the user, for example, by limiting unintentional user contact with the operating bit 120. In addition, the hollow shaft 112 partially defines an operating depth (e.g. a cutting depth) of the operating bit 120 by limiting the exposed length of the operating bit 120.

The joint raking tool attachment 102 further includes a sled 116, attached to the hollow shaft 112, and configured to interface with the working surface. During a joint raking operation, a substantially flat bottom surface of the sled 116 is configured to lay flush against the working surface, partially defining the operating depth of the operating bit 120. While the bottom surface of the sled 116 is substantially flat, in some cases, the edges of the sled 116 may be configured to curve away from the working surface to smoothly guide the joint raking system 100 along the working surface and reduce wear of the sled 116. In some cases, the bottom surface of the sled 116 may be textured (e.g. with patterns or designs carved in) to provide better traction with the working surface and prevent debris from getting trapped underneath the sled 116. In some cases, a front aspect of the sled 116 may be bifurcated (e.g. into bifurcated halves 204A, 204B) to expose an operating path of the operating bit 120. This exposure may provide visual feedback to a user to assist in guiding the joint raking system 100 and may prevent debris from getting trapped underneath the sled 116.

In some cases, the sled 116 forms an acute angle with the hollow shaft 112. The acute angle may contribute to reduced user fatigue, since as the user pushes the joint raking system 100 against the working surface, a component force substantially parallel to the working surface assists in guiding the joint raking system 100 along an intended operating path. In some cases, a support member 202 may be included between the sled 116 and the hollow shaft 112 so that their relative positions do not substantially change when a user pushes the joint raking system 100 against the working surface. While the sled 116 and the hollow shaft 112 form an acute angle in FIGS. 2A-C, it is understood that in some implementations the sled 116 and the hollow shaft 112 may also be configured to form a right angle or an obtuse angle.

As previously described, the operating depth (e.g. the cutting depth) of the operating bit is partially defined by the hollow shaft 112 and the sled 116. For joint raking implementations, a desired operating depth may be approximately 2.5 times a width of the mortar joint. In some cases, the operating depth of a joint raking system (e.g. joint raking system 100) can be adjusted by replacing the joint raking tool attachment 102 with another joint raking tool attachment having a hollow shaft of a different length. In some cases, the hollow shaft 112 of the joint raking tool attachment 102 may have an adjustable length, enabling a single joint raking tool attachment 102 to allow for various operating depths. In some cases, the operating depth can be adjusted by repositioning the sled 116 at different points along the length of the hollow shaft 112.

Referring to FIGS. 2A and 2B, the joint raking tool attachment 102 can further include a guidance fin 206 protruding from the bottom surface of the sled 116. In some cases, the guidance fin 206 can protrude substantially perpendicularly from the bottom surface of the sled 116. In some cases, other angles may be use. During a joint raking operation, the guidance fin 206 is configured to sit within the mortar joint, preventing the power tool from unintentionally exiting the mortar joint and causing damage to the individual units of the masonry constructed structure. In some cases, the guidance fin 206 is filleted and has a width less than the width of the operating bit 120 to prevent the guidance fin 206 from binding within the mortar joint. In some cases, the guidance fin 206 is of an appropriate length to support a portion of the normal load of the joint raking system 100 during operation, effectively reducing the load the user must support. In some cases, other geometries of the guidance fin 206 may be implemented. While a single guidance fin 206 is shown in FIGS. 2A and 2B, it is understood that in some implementations, the joint raking tool attachment 102 may comprise a plurality of guidance fins. For example, in some cases, the joint raking tool attachment 102 may comprise two guidance fins aligned substantially parallel to each other or having their leading edges in contact (e.g. to have a geometry such as a two-bladed snow plow).

In some implementations, dimensions of the hollow shaft 112, the sled 116, the guidance fin 206, or any combination of them may be adjustable. For example, in some cases, the hollow shaft 112 can telescope to a different length. In some cases, the sled 116 can be lengthened or shortened to adjust an area that interfaces with the working surface. In some cases, the guidance fin 206 may have an adjustable length, or depth, or both.

The sled 116, the guidance fin 206, or both can be made of metals such as steel so that they are durable against wear. In some cases, the sled 116, the guidance fin 206, or both can be made of plastic, a combination of materials, etc. and may be replaced (e.g., to address wear and tear, to interface with different types of work surfaces, etc.) In some cases, the sled 116, the guidance fin 206, or both can be coated with wear-resistant materials such as chromes, carbides, ceramics, epoxies, teflons, diamond, etc.

Figure 3A:
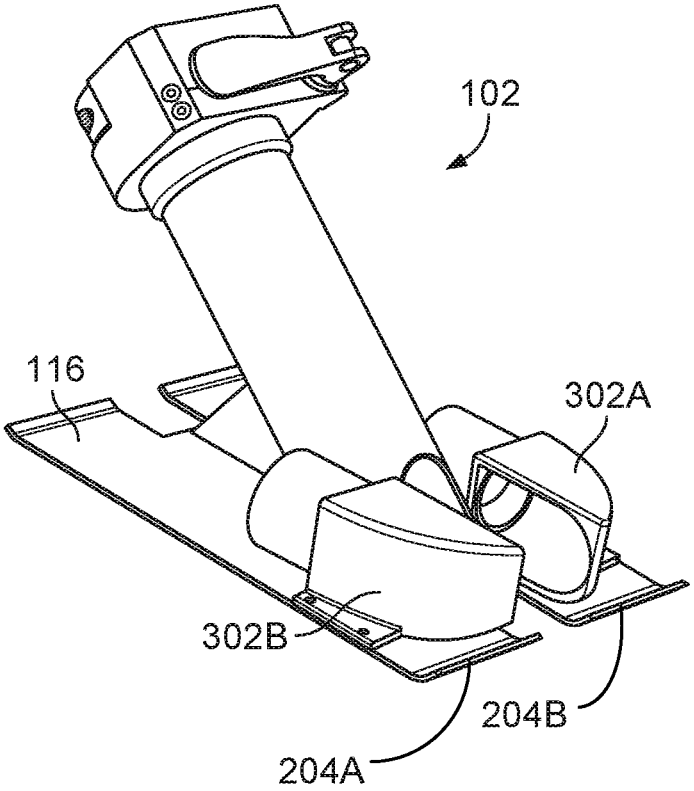
FIG. 3A is a side perspective view of a joint raking tool attachment with dual vacuum ports.
Figure 3B:
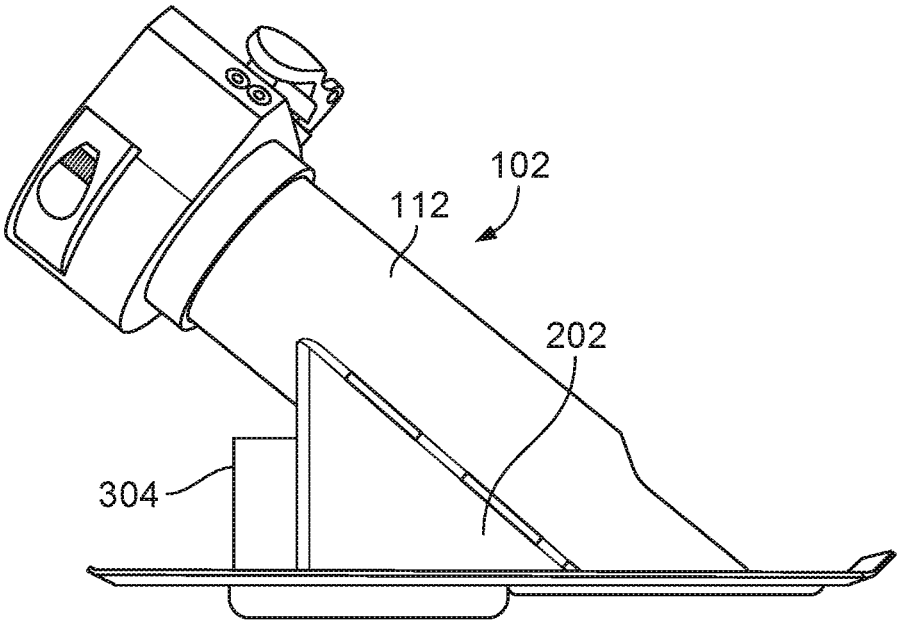
FIG. 3B is a side view of a joint raking tool attachment with a single vacuum port.

Referring to FIGS. 3A and 3B, in some implementations, the joint raking tool attachment 102 may include features to provide other functionality. For example, one or more vacuum ports may be included, which may interface with a vacuum device to capture debris during a joint raking operation. In some cases, the amount of debris captured is sufficient to be compliant with a regulated threshold (e.g. a threshold established by silica laws). One or more blowers may be employed in some implementations, with or without the use of vacuum ports. In still another example, a liquids may be introduced (e.g. one or more jet sprays that introduce water streams into the operating path of the operating bit 120).

FIG. 3A illustrates a configuration of the joint raking tool attachment 102 with dual vacuum ports 302A, 302B. In this configuration, the dual vacuum ports 302A, 302B are mounted symmetrically on a top surface of the sled 116, with each vacuum port resting on one of two bifurcated halves 204A, 204B of the sled 116. The openings of the vacuum ports 302A, 302B are configured to be proximal to an interface of the operating bit 120 and the working surface during a joint raking operation in order to improve the capture of debris. In some cases, the dual vacuum ports 302A, 302B may be mounted to the sled 116 using sprung steel clips, fasteners, etc. to allow for one or both of the vacuum ports 302A, 302B to be removed. In some cases, the vacuum ports may be irremovably mounted to the sled 116. While the bifurcated halves 204A, 204B of the sled 116 are depicted with equivalent geometries and dimensions, it is understood that in some cases, they may be asymmetric. For example, in some cases, the degree of curvature of the leading edges of the bifurcated halves 204A, 204B can be different or the length of each of the bifurcated halves 204A, 204B can be different.

FIG. 3B illustrates a configuration of the joint raking tool attachment 102 with a single vacuum port 304. In this configuration, the vacuum port is built into support member 202 and extends into the hollow shaft 112. Again, the opening of the vacuum port 304 is configured to be proximal to an interface of the operating bit 120 and the working surface during a joint raking operation in order to improve the capture of debris.

Figure 4A:
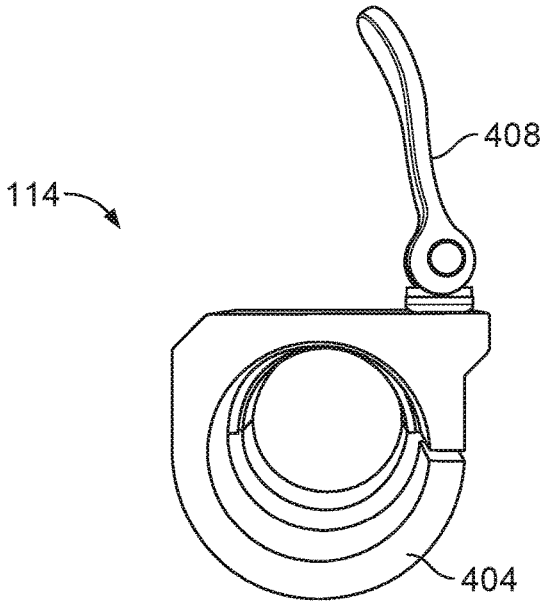
FIG. 4A is a bottom view of a split collar clamp.
Figure 4B:
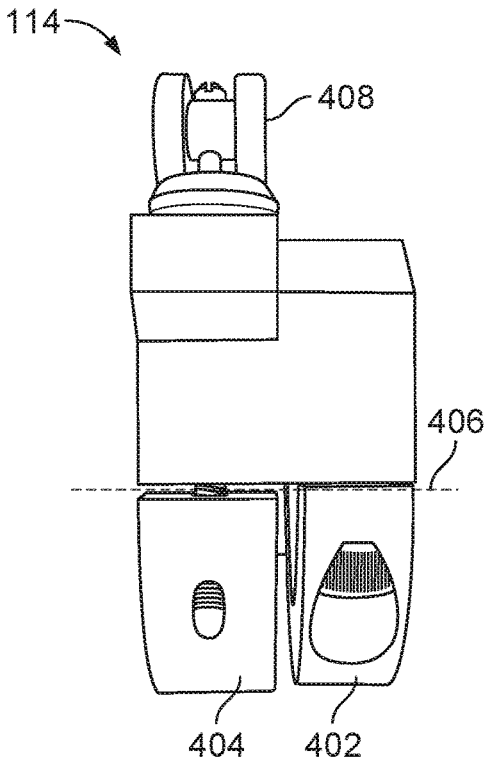
FIG. 4B is a side view of a split collar clamp.
Figure 4C:
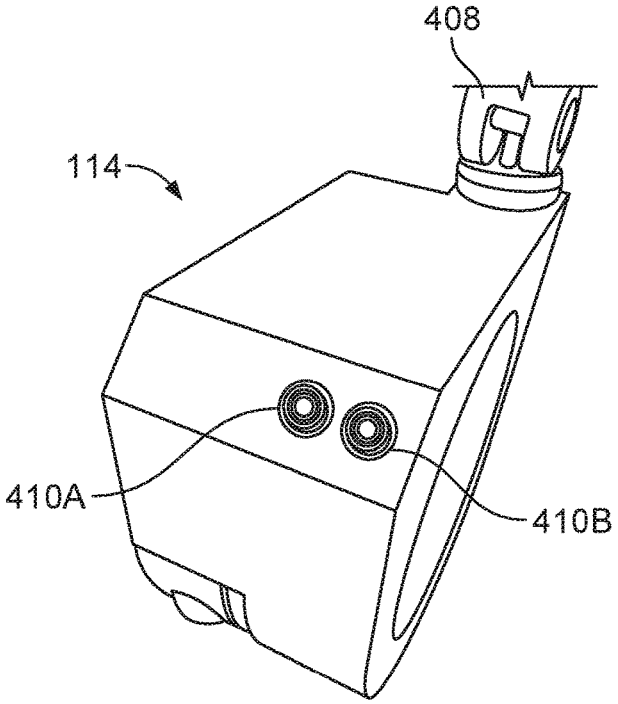
FIG. 4C is a perspective view of a split collar clamp.

Referring to FIGS. 4A-C, the split collar clamp 114 is isolated and shown from multiple perspectives. FIG. 4A illustrates a bottom view, FIG. 4B illustrates a side view, and FIG. 4C illustrates a perspective view of the split collar clamp 114.

In this implementation, the split collar clamp 114 is a dual clamp that attaches the joint raking tool attachment 102 to the rotary hammer drill 104. A power tool half 402 of the split collar clamp 114 mounts to the rotary hammer drill 104 (e.g. to the chuck of the rotary hammer drill) with a threaded fastener threading across a split axis 406 to tighten the clamp. A tool attachment half 404 of the split collar clamp 114 mounts to the proximal end of the hollow shaft 112 of the joint raking tool attachment 102 with a threaded fastener threading across the split axis 406 to tighten the clamp. The tool attachment half 404 of the split collar clamp 114 further tightens via the use of a cam handle 408. In some cases, the cam handle 408 can be considered a cam-operated tightening mechanism.

FIG. 4A illustrates the cam handle 408 in an unlocked configuration, in which the tool attachment half 404 of the split collar clamp 114 is loosened such that the joint raking tool attachment 102 would be able to rotate relative to the split collar clamp 114. FIG. 4B illustrates the cam handle 408 in a locked configuration, in which the tool attachment half 404 of the split collar clamp 114 is tightened such that the joint raking tool attachment 102 would be unable to rotate relative to the split collar clamp 114. In some implementations, the cam handle 108 can be designed so that in the locked configuration, the handle does not protrude substantially from the surface of the split collar clamp 114, thus preventing accidental displacement of the cam handle 108 while operating the joint raking system 100. When the cam handle 108 is in a locked configuration, the split collar clamp 114 is also considered to be in a locked configuration. Similarly, when the cam handle 108 is in an unlocked configuration, the split collar clamp 114 is also considered to be in an unlocked configuration.

Referring to FIG. 4C, in some implementations, the split collar clamp 114 may further comprise ball detents 410A, 410B for locating one or more predetermined rotation positions of the joint raking tool attachment 102. The use of ball detents 410A, 410B for locating predetermined rotation positions of the joint raking tool attachment 102 are described in relation to FIGS. 5A, 5B, and 6. While ball detents are described, other types of locating features may be employed. For example, a visual indicator on both the split collar clamp 114 and the hollow shaft 112 may be included for alignment, or keyhole-like geometries which may constrain the joint raking tool attachment 102 to specific positions. In some cases, no locating features may be used, allowing the joint raking tool attachment 102 to lock into any rotation position relative to the rotary hammer drill 104.

Figure 5A:
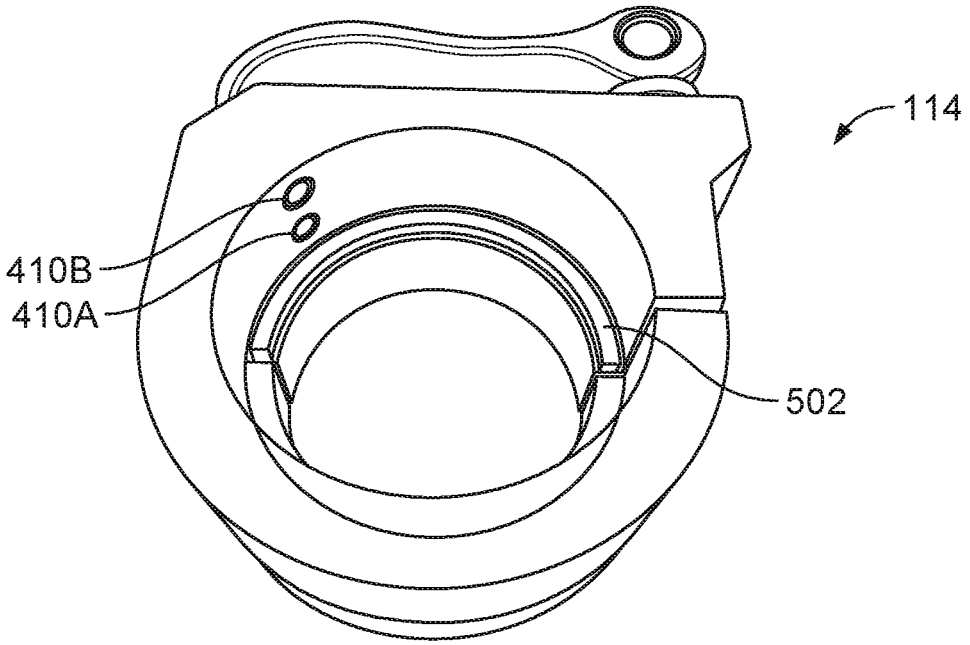
FIG. 5A is a magnified bottom perspective view of a split collar clamp.
Figure 5B:
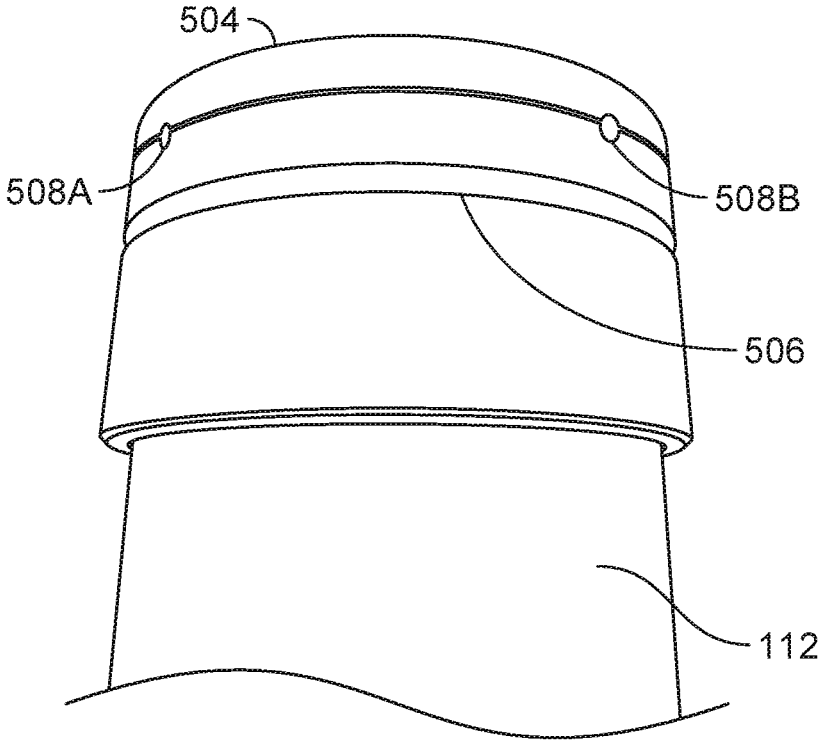
FIG. 5B is a magnified view of a joint raking tool attachment.

Referring to FIGS. 5A and 5B, the ball detents 410A, 410B protrude into an inner surface of the split collar clamp 114. The proximal end of the hollow shaft 112 is inserted into the split collar clamp 114 and is stopped when a proximal edge 504 comes into contact with an inner lip 502 of the split collar clamp 114. At this depth, one ball detent 410A is in line with locator features 508A, 508B on the hollow shaft 112, and another ball detent 410B is in line with a guidance groove 506 on the hollow shaft 112. While the split collar clamp 114 is in an unlocked configuration, the hollow shaft 112 is free to rotate about its longitudinal axis and provides tactile feedback to the user whenever ball detent 410A locates a locator feature (e.g. locator features 508A, 508B). When the user feels the tactile feedback, the user can tighten the split collar clamp 114 into a locked configuration such that the hollow shaft 112 is unable to rotate about its longitudinal axis. In some implementations, locator features may be spaced out at 90 degree intervals. While 90 degree intervals are depicted, it is understood that any number of locator features may be used, and the locator features may be spaced out at any intervals, including uneven intervals.

Figure 6A:
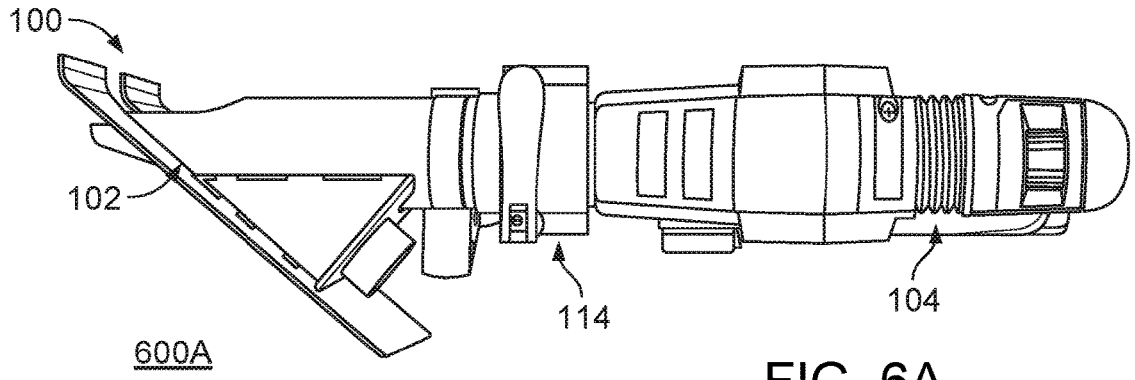
FIGS. 6A-C illustrate adjustable configurations of a rotary hammer drill with a joint raking tool attachment.
Figure 6B:
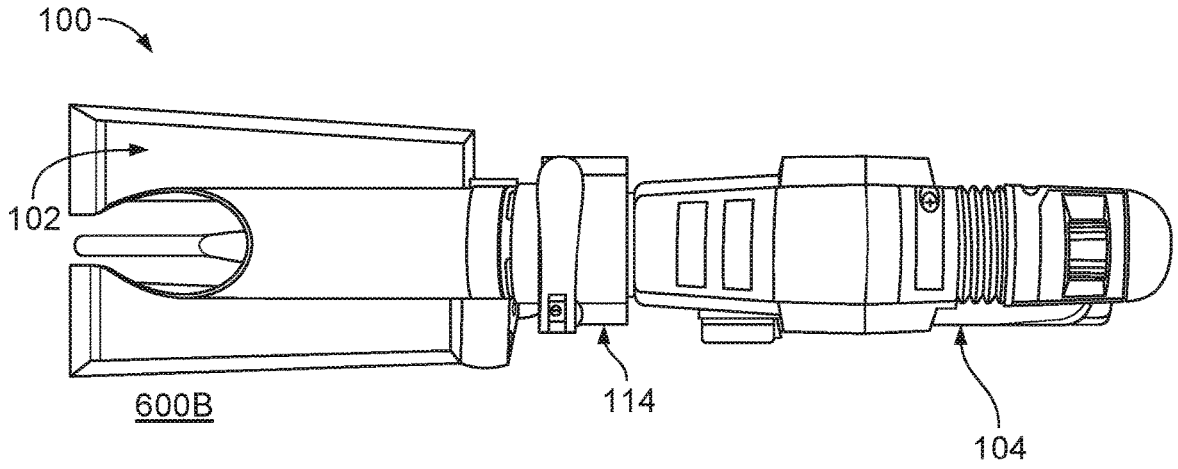
Figure 6C:
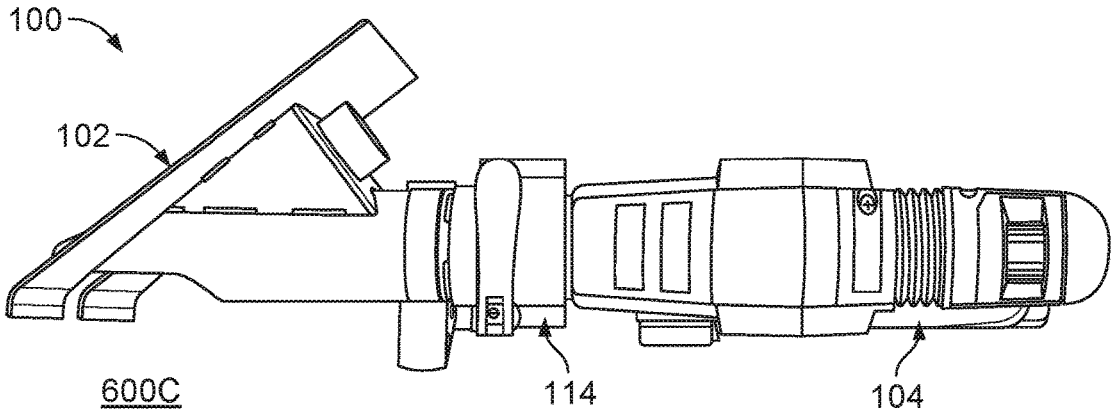

FIGS. 6A-C illustrates predetermined rotation positions of the joint raking tool attachment 102 relative to the rotary hammer drill 104 in accordance with locator features (e.g. locator features 508A, 508B) spaced out at 90 degree intervals. In FIG. 6A, a first configuration 600A represents the joint raking tool attachment 102 being rotated 90 degrees clockwise about the longitudinal axis of the hollow shaft 112. In FIG. 6B, a second configuration 600B represents the joint raking tool attachment 102 being rotated 0 degrees about the longitudinal axis of the hollow shaft 112. In FIG. 6C, a third configuration 600C represents the joint raking tool attachment 102 being rotated 90 degrees counterclockwise about the longitudinal axis of the hollow shaft 112. To rotate the joint raking tool attachment 102 relative to the rotary hammer drill 104, a user simply unlocks the split collar clamp 114, rotates the joint raking tool attachment 102 to a desired position, and locks the split collar clamp 114 to fix the joint raking tool attachment in place. This rotational feature enables adjustment for both left-handed and right-handed users and allows a single user to periodically switch between left-handed and right-handed orientations to reduce fatigue. Furthermore, by allowing for rotation of the joint raking tool attachment 102 at 90 degree intervals, the joint raking system 100 is useful for removing mortar from both horizontal and vertical mortar joints.

While a tool attachment is described, in some cases, a dedicated power tool may also be used, comprising similar features to the tool attachment, but in an irremovable configuration. For example, the hollow shaft 112 may be permanently fixed to the operating element of the power tool or could be a continuous piece of material. In such an embodiment, a connecting feature such as the split collar clamp 114 would not be required.

A number of embodiments have been described. Nevertheless, it will be understood that various modifications can be made without departing from the spirit and scope of the apparatus, systems, and techniques described herein. In addition, other components can be added to, or removed from, the described apparatus and systems. Accordingly, other embodiments are within the scope of the following claims.

What is claimed is:

1. An apparatus configured to be attached to a power tool having an operating element, the apparatus comprising:

a hollow shaft having a longitudinal axis, the hollow shaft configured to surround the operating element of the power tool;

a substantially flat sled having a longitudinal axis, wherein a top surface of the sled is connected to a distal end of the hollow shaft such that the longitudinal axis of the sled is oriented at an acute angle relative to the longitudinal axis of the hollow shaft, and wherein a bottom surface of the sled is configured to interface with a working surface; and a guidance fin protruding from the bottom surface of the sled, wherein the guidance fin is configured to guide the apparatus along an operating path.

2. The apparatus of claim 1, wherein the guidance fin protrudes substantially perpendicularly from the bottom surface of the sled.

3. The apparatus of claim 1, wherein the guidance fin is configured to fit into a mortar joint.

4. The apparatus of claim 1, wherein a width of the guidance fin is less than a width of the operating element of the power tool.

5. The apparatus of claim 1, wherein the power tool is a rotary hammer drill.

6. The apparatus of claim 1, wherein at least one edge of the substantially flat sled is configured to curve away from the working surface.

7. The apparatus of claim 1, wherein the apparatus is configured to rotate relative to the power tool about a longitudinal axis of the hollow shaft.

8. The apparatus of claim 1, wherein a dimension of at least one of the hollow shaft, the sled, and the guidance fin is adjustable.

9. The apparatus of claim 1, wherein a front aspect of a distal end of the hollow shaft has a cutout.

10. The apparatus of claim 1, wherein a front aspect of the sled is bifurcated.

11. The apparatus of claim 1, further comprising at least one vacuum port attachment.

12. The apparatus of claim 11, wherein the at least one vacuum port attachment is built into a support member of the apparatus.

13. The apparatus of claim 1, further comprising a clamp configured to mount the apparatus to the power tool.

14. The apparatus of claim 13, wherein the clamp is configured to interface with a chuck of the power tool.

15. The apparatus of claim 13, wherein the clamp is a split collar clamp.

16. The apparatus of claim 13, wherein the clamp has a cam-operated tightening mechanism.

17. The apparatus of claim 13, wherein the clamp comprises at least one locator feature for locating at least one predetermined position of the apparatus.

18. A system comprising: a power tool with an operating element; and an attachment comprising:

a hollow shaft having a longitudinal axis, the hollow shaft configured to surround the operating element; a substantially flat sled having a longitudinal axis, wherein a top surface of the sled is connected to a distal end of the hollow shaft such that the longitudinal axis of the sled is oriented at an acute angle relative to the longitudinal axis of the hollow shaft, and wherein a bottom surface of the sled is configured to interface with a working surface; and a guidance fin protruding perpendicularly from the bottom surface of the sled, wherein the guidance fin is configured to guide the apparatus along an operating path.

19. The system of claim 18, wherein the attachment is irremovably fixed to the power tool.

20. The system of claim 18, wherein the guidance fin protrudes substantially perpendicularly from the bottom surface of the sled.

21. The system of claim 18, wherein a width of the guidance fin is less than a width of the operating element of the power tool.

22. The system of claim 18, wherein the power tool is a rotary hammer drill.

23. The system of claim 18, wherein the sled is configured to rotate relative to the power tool about a longitudinal axis of the hollow shaft.

24. The system of claim 18, wherein a dimension of at least one of the hollow shaft, the sled, and the guidance fin is adjustable.

25. The system of claim 18, wherein a front aspect of a distal end of the hollow shaft has a cutout.

26. The system of claim 18, wherein a front aspect of the sled is bifurcated.

27. The system of claim 18, further comprising at least one vacuum port attachment.

28. An apparatus configured to be rotatably attached to a power tool having an operating element the apparatus comprising:

a hollow shaft having a longitudinal axis, the hollow shaft configured to surround the operating element of the power tool, a front aspect of a distal end of the hollow shaft having a cutout;

a substantially flat sled having a longitudinal axis, wherein a top surface of the sled is connected to a distal end of the hollow shaft such that the longitudinal axis of the sled is oriented at an acute angle relative to the longitudinal axis of the hollow shaft, wherein a front aspect of the sled is bifurcated, and wherein a bottom surface of the sled is configured to interface with a working surface;

a guidance fin protruding substantially perpendicularly from the bottom surface of the sled and having a width that is less than a width of the operating element of the power tool, the guidance fin configured to fit inside a mortar joint and guide the apparatus along an operating path;

at least one vacuum port attachment built into a support member of the apparatus; and a split collar clamp configured to interface with a chuck of the power tool, the clamp having a cam-operated tightening mechanism and at least one locator feature for locating at least one predetermined position of the apparatus;

wherein the apparatus is configured to rotate relative to the power tool about a longitudinal axis of the hollow shaft.

* * * * *